US005258765A

United States Patent [19]

Dörrie et al.

[11] Patent Number: 5,258,765

[45] Date of Patent: Nov. 2, 1993

[54] ROD-SHAPED MULTI-BAND ANTENNA

[75] Inventors: Horst Dörrie; Uwe Militz; Heinrich Wilken, all of Berlin, Fed. Rep. of Germany

[73] Assignee: Robert Bosch GmbH, Stuttgart, Fed. Rep. of Germany

[21] Appl. No.: 852,670

[22] Filed: Mar. 17, 1992

[30] Foreign Application Priority Data

Mar. 23, 1991 [DE] Fed. Rep. of Germany ..... 4109630

[51] Int. Cl.[5] ..... H01Q 9/32; H01Q 5/01

[52] U.S. Cl. ..... 343/722; 343/715; 343/749

[58] Field of Search ..... 343/722, 749, 903, 900, 343/715

[56] References Cited

U.S. PATENT DOCUMENTS 4,145,693 3/1979 Fenwick ..... 343/722

4,675,687 6/1987 Elliott ..... 343/722

*Primary Examiner*—Michael C. Wimer

*Attorney, Agent, or Firm*—Frishauf, Holtz, Goodman & Woodward

[57] ABSTRACT

Rod-shaped multi-band antennas require at least one parallel resonance circuit for separating the individual frequency bands, which consists of a coil and a discrete capacitor. Multi-band antennas of this type for a maximum of three frequency bands are as a rule only suitable for a frequency range from 3 to 30 MHz. In a multi-band antenna (10) suitable for four frequency bands, a first coil (15) is located between a first and a second straight wire piece (14, 16), and a second coil (17) between the second, straight wire section (16) and a third, straight wire piece (18). The first coil constitutes a parallel resonance circuit or a trap circuit, and the second coil a phase shift coil. The multi-band antenna is particularly suited as a vehicle aerial to which a car radio for the AM and FM ranges as well as a mobile telephone for two different nets is connected. The drawing illustrates a rod-like multi-band antenna in accordance with the invention.

9 Claims, 1 Drawing Sheet

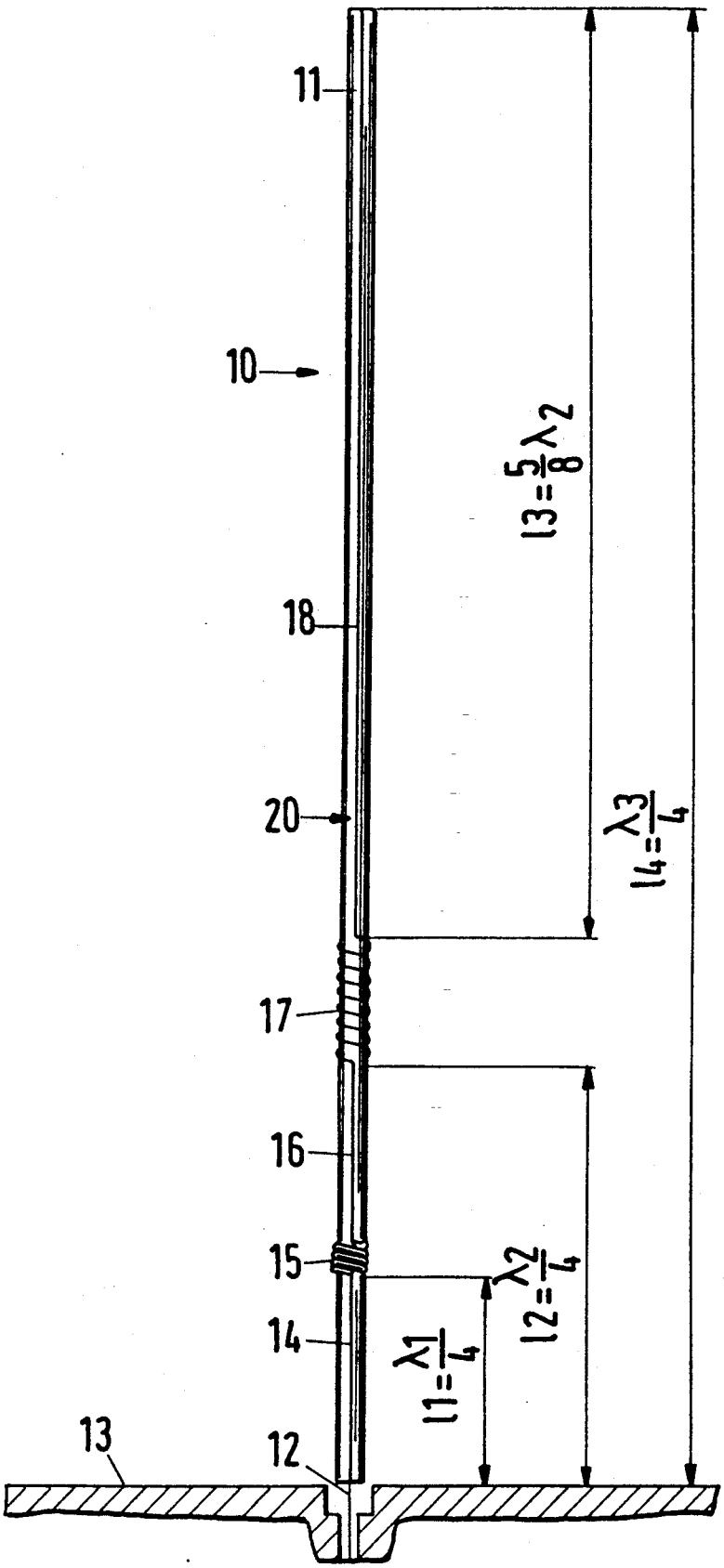
11
10
18
20
17
16
15
14
13
12
$l3=\frac{5}{8}\lambda 2$
$l4=\frac{\lambda 3}{4}$
$l2=\frac{\lambda 2}{4}$
$l1=\frac{\lambda 1}{4}$

ROD-SHAPED MULTI-BAND ANTENNA

Cross-reference to Related Applications and Patents, the Disclosures of Which are Incorporated by Reference Dorrie & Klinkwitz, U.S. Pat. No. 4,375,642, Mar. 1, 1983; Dorrie & Militz, U.S. Ser. No. 07/448,750, filed Dec. 11, 1989; now U.S. Pat. No. 5,057,849, issued Oct. 15, 1991; Dorrie & Militz, U.S. Ser. No. 07/460,743, filed Jan. 4, 1990; now U.S. Pat. No. 5,177,494, issued Jan. 5, 1993; Dorrie, U.S. Pat. No. 5,061,942, Oct. 29, 1991.

FIELD OF THE INVENTION

The invention relates to a rod-shaped multi-band antenna having an insulating material rod as support for a wire extending over the entire length of the rod.

BACKGROUND

Such a multi-band antenna is known from U.S. Pat. No. 4,145,693 and is suitable for three different frequency bands between 3 and 30 MHz. In this case the frequency bands must be in a ratio of 1:2:4, starting with the lowest frequency band. Examples cited are mean operating frequencies of 3.5 MHz, 7 MHz and 14 MHz.

THE INVENTION

It is an object of the invention to improve the known multi-band antenna is such a way that it becomes broad-band and can be used for four different frequency bands, namely preferably for a first, highest frequency band of, for example, 825 to 960 MHz (AMPS-net or D-net of the German Federal Postal Service), for a second, next-highest frequency band of, for example, 450 to 470 MHz (C-net of the German Federal Postal Service), for a third, second-lowest frequency band of, for example, 75 to 115 MHz (FM radio range), and a fourth, lowest frequency band of, for example, 150 kHz to approximately 6 MHz (AM radio range).

This object is attained, in a rod-shaped, multi-band antenna by suitably dimensioning straight antenna sections and coils. The multi-band antenna in accordance with the invention has the advantage that with small technical effort it is possible to provide a broad-band multi-band antenna for four frequency ranges. Without the use of a discrete capacitor, the first coil forms a parallel resonant circuit which makes a portion of the antenna currentless and in this way causes the separation of different frequency bands.

The rod-shaped, multi-band antenna of the invention is particularly practical as a vehicle aerial, to which a car radio for the AM and FM range as well as a mobile telephone, which can be switched to two different system, are connected.

An exemplary embodiment of the invention is shown in the drawings and will be described in detail below.

DRAWINGS

The single drawing figure shows a plan view of a rod-shaped, multi-band antenna.

DETAILED DESCRIPTION

A plan view of a rod-shaped, multi-band antenna 10 with an insulating material rod 11 is shown in the single drawing figure, which, looking from the base point 12 or from a reference plane 13 located on the ground potential, has a first, straight wire section 14, a first coil

15 connected therewith, a second, straight wire section 16 connected therewith, a second coil 17 connected therewith and an adjoining third, straight wire section 18. The straight wire sections 14, 16, 18 are located on a common axis, which is on the outside of the rod parallel to the longitudinal symmetry axis of the insulating material rod 11. Preferably the wire sections 14, 16, 18 and the coils 15, 17 are made from a single piece of wire 20 connected to the insulating material rod 11 by means of an adhesive connection, for example. The complete wire piece 20 can preferably be pre-assembled, dipped into an adhesive and placed on the insulating material rod. After hardening of the adhesive, the wire piece 20 sits fixedly on the insulating material rod, which preferably is a fiberglass rod.

The wire piece 20 has the following dimensions, for example: The length L1 of the first, straight wire section 14 is $\lambda 1/4$, where $\lambda 1$ is the mean operating wavelength of the highest frequency band of, for example, 825 to 960 MHz. The first coil 15 has such dimensions that its inductive and capacitive components form a parallel circuit or a trap circuit which is tuned to the mean operating wavelength $\lambda 1$. The first, straight wire section 14 and a second, straight wire section 16 together with the coil 15 located between them have an aggregate length $L2=\lambda 2/4$, where $\lambda 2$ is the mean operating wavelength of the second-highest frequency band of, for example, 450 to 470 MHz.

The second coil 17 is used for phase shifting. At the mean operating wavelength $\lambda 2$ it generates a phase shift of, for 135°.

While the first coil 15 has a plurality of closely adjoining windings, the second coil 17 has a plurality of windings at a distance from each other.

The third, straight wire section 18 has a length of $L3=\frac{5}{8}\lambda 2$, and the entire wire piece 20 has a length of $L4=\lambda 3/4$, where $\lambda 3$ is the mean operating wavelength of the second-lowest frequency range of, for example, 75 to 155 MHz. The wire piece is preferably made of lacquered copper wire.

The rod-shaped, multi-band antenna 10 illustrated in the drawing figure is enclosed in a layer of insulating material, left out of the drawing figure for the sake of clarity, which is, for example, a heat-shrinkable tube of insulating material or a thin layer of insulating material created by dipping.

The mode of operation of the rod-shaped antenna described above is as follows:

The first wire section 14 forms a $\lambda 1/4$ antenna for the highest frequency band. A stacked $\lambda 2/4+\frac{5}{8}\lambda 2$ antenna functions together with the phase shift coil 17 in the second-highest frequency band. For the second-lowest and the lowest frequency bands the $\lambda 3/4$ antenna takes effect, which is tuned to the VHF range and has satisfactory properties even in the lowest frequency band, for example the AM frequency band.

Various changes and modifications may be made, and features described in connection with any one of the embodiments may be used with any of the others, within the scope of the inventive concept.

We claim:

1. A rod-shaped multi-bank antenna (10) having an insulating material rod (11) as support for a wire (20) extending over the entire length of the rod and having a free end, comprising a first, straight wire section (14), which connects a base point (12) of the multi-band antenna (10) with an end of a first coil (15);

a second, straight wire section (16), which connects the other end of the first coil with an end of a second coil (17), and a third, straight wire section (18) leading from the other end of the second coil to the free end, of the multi-band antenna (10), remote from said base point (12);

said insulating material rod (11) being generally cylindrical, with a central longitudinal axis of symmetry, said straight wire sections (14, 16, 18) extending on the same axis with respect to each other and parallel to the longitudinal symmetry axis of the insulating material rod (11); wherein the first straight wire section has a length $L_1=\lambda_1/4$, suitable for receiving a first frequency band, the second straight wire section (16), together with the first straight wire section (14) and the first coil (15), have an aggregate length $L_2=\lambda_2/4$, suitable for receiving a second frequency band, lower than said first frequency band, the third wire section (18) has a length $L_3=\frac{5}{8}\lambda_2$, suitable for receiving in said second frequency band, and the entire multi-band antenna has an electrical length $L_4=\lambda_3/4$, suitable for receiving third and fourth frequency bands, and where $\lambda_3$ is the mean operational wavelength of the third frequency band;

the first coil (15) forms a parallel resonant circuit tuned to the mean operational wavelength $\lambda_1$ of said first frequency band, and the second coil (17) is a phase shift coil tuned to the mean operational wavelength $\lambda_2$ of the second frequency band.

2. A multi-band antenna in accordance with claim 1, wherein said first, second and third straight wire sections (14, 16, 18) and said first and second coils (15, 17) are an uninterrupted wire piece (20).

3. A multi-band antenna in accordance with claim 2, wherein the wire piece (20) is made of lacquered copper wire.

4. A multi-band antenna in accordance with claim 1, wherein the insulating material rod (11) is a fiberglass rod.

5. A multi-band antenna in accordance with claim 1, wherein at least the straight wire sections (14, 16, 18) are glued onto the insulating material rod (11).

6. A multi-band antenna in accordance with claim 1, wherein the insulating material rod and the wire are enclosed in a common layer of insulating material.

7. A multi-band antenna in accordance with claim 1, wherein the multi-band antenna is a vehicle aerial.

8. A multi-band antenna in accordance with claim 1, wherein the first coil (15) is a coil consisting of a plurality of closely adjoining windings.

9. A multi-band antenna in accordance with claim 1, wherein the second coil (17) is a coil consisting of a plurality of windings spaced a distance from each other.

* * * * *